US006467211B1

(12) United States Patent
Kielland

(10) Patent No.: US 6,467,211 B1
(45) Date of Patent: Oct. 22, 2002

(54) TRIGGER LOCK

(76) Inventor: Peter Kielland, 310 Selby Avenue, Ottawa, Ontario (CA), K1Z 6R1

( * ) Notice: Subject to any disclaimer, the term of this patent is extended or adjusted under 35 U.S.C. 154(b) by 0 days.

(21) Appl. No.: 09/708,053

(22) Filed: Nov. 8, 2000

(30) Foreign Application Priority Data

Jun. 30, 2000 (CA) ..... 2313428

(51) Int. Cl.[7] ..... F41A 17/00
(52) U.S. Cl. ..... 42/70.07; 42/70.06
(58) Field of Search ..... 42/70.01, 70.04, 42/70.06, 70.08, 70.07, 70.11; 248/552

(56) References Cited

U.S. PATENT DOCUMENTS 3,031,787 A * 5/1962 Womble, Jr. ..... 42/70.07
3,368,297 A * 2/1968 Lentz ..... 42/70.07
4,198,026 A * 4/1980 Capolupo ..... 248/552
5,153,360 A * 10/1992 Upton ..... 42/70.11
5,367,811 A * 11/1994 Sansom ..... 42/70.07
5,551,181 A * 9/1996 Upton ..... 42/70.11
5,724,760 A * 3/1998 Langer ..... 42/70.07
5,927,578 A * 7/1999 Kay ..... 224/244

* cited by examiner

*Primary Examiner*—Charles T. Jordan
*Assistant Examiner*—Danielle Rosenthal

(57) ABSTRACT

A trigger lock for a firearm lock is disclosed comprising a trigger lock body having a trigger blocking portion. The trigger blocking portion has a head and a body for placement behind the trigger to prevent rearward movement of the trigger to a firing position. The trigger lock body includes a flange adjacent to and integral with the trigger blocking portion for positioning in an abutting relationship with the trigger guard thereby preventing lateral and twisting movement of the trigger blocking portion once placed behind the trigger. There is provided at least one shoulder portion extending laterally from the head of the body beyond the corresponding side of the trigger guard when the body is placed behind the trigger to resisting twisting motion. The trigger lock body mounts to a shackle of a padlock so that the body and padlock shackle to which it is mounted forms a unitary trigger guard for insertion behind the trigger.

15 Claims, 11 Drawing Sheets

TRIGGER LOCK

CROSS-REFERENCE TO RELATED APPLICATIONS

This application is entitled to the benefit of Canadian Patent Application 2,231,428 filed on Jun. 30, 2000.

BACKGROUND

1. Field of the Invention

This invention relates to firearms, specifically to a trigger lock for a firearm to prevent the trigger device from movement.

2. Description of the Prior Art

Unauthorized or inadvertent discharge of a firearm is a problem that injures or kills many people. This problem is particularly acute and distressing in the case of children who play with their parent's firearm. The prior art reveals many attempts to alleviate this problem by selectively disabling the gun by locking blocking devices to obstruct the barrel of the gun or by locking trigger blocking or guarding devices to the trigger guard.

One such prior art device is described in U.S. Pat. No. 5,910,002 issued to Hunter on Jun. 8, 1999 and entitled "Gun Trigger Safety Device". Hunter describes a trigger-blocking plug that conforms to the space behind the trigger to prevent the weapon from firing. However, the Hunter device cannot be securely locked to the weapon to disable it and therefore it is unsuitable for securing safe a weapon in a home or for long periods of time.

Another attempt at a plug-type tigger safety device is described in U.S. Pat. No. 5,724,760 issued to Langner on Mar. 10, 1998 and entitled "Trigger Safety Device". Langer discloses a design that permits a trigger blocking device to be locked to the weapon. Langner's device includes a horizontal extension from one side of the trigger-blocking plug that includes a hole at right angles to the plug's axis and through which a small padlock may be engaged. Since the padlock shackle is disposed at right angles to the plug, it engages a side of the trigger guard and trigger to prevent unauthorized removal of the plug from behind the trigger. However, the padlock shackle may be used to twist and break the extension and thereby free the device from the firearm. As well, Langner teaches a two-piece system comprising a lock and a separate trigger blocking device leaving the smaller trigger blocking device vulnerable to misplacement and loss. Additionally, the separate padlock dangles freely from the firearm and therefore may scratch the finish of the gun.

SUMMARY

In accordance with my present invention there is provided a trigger lock for a firearm having a barrel, a frame, a handle and a trigger depending from the bottom of the frame and disposed in front of the handle. The trigger lock comprises a trigger lock body comprising a trigger blocking portion for placement behind the trigger to prevent rearward movement of the trigger to a firing position. Also included is a flange adjacent to and integral with the trigger blocking portion for positioning in an abutting relationship with one side of the trigger guard to prevent lateral and twisting movement of the trigger blocking portion. Also included is a padlock having a locking body with a top surface and a U-shaped shackle. The shackle has a curved head from which depends a first leg lockably disengagable from the top surface of the locking body and a second leg pivotally and permanently engaged to the top surface of the locking body. Means for removably mounting the guard body in a cooperative frictional engagement on to the free leg of the shackle is also provided. This permits the guard body and shackle first leg combination to be positioned horizontally behind the trigger as a single piece so that when the trigger blocking portion is behind the trigger and the padlock is closed, the top surface of the padlock creates an abutment abutting against the trigger guard opposite the first flange preventing movement of the trigger blocking portion.

Objects and Advantages

Accordingly, several objects and advantages of my invention are:

a. to provide a trigger lock that overcomes the deficiencies observed in the prior art;

b. to provide a trigger lock that permits the locked gun to be safely stored in a loaded condition;

c. to provide a trigger lock that can be quickly fitted to and removed from the gun;

d. to provide a trigger lock that may be easily adapted to fit a wide variety of existing firearms;

e. to provide a trigger lock that is difficult for unauthorized persons to remove;

f. to provide a simplified gun trigger lock that is inexpensive to manufacture using off the shelf padlocks; and, g. to provide a trigger lock that does not scratch the gun to which it is affixed.

A further object and advantage of my invention is to provide a trigger lock that can be mounted to the shackle of a commercial padlock without further modification to the padlock and create a single piece device that is difficult to misplace or loose.

Still further objects and advantages of my invention will become apparent from a consideration of the ensuing description and drawings.

BRIEF DESCRIPTION OF THE DRAWINGS

FIG. 3 illustrates a typical trigger guard in side view that my invention may be adapted to.

DETAILED DESCRIPTION

One advantage of my invention is that it is used in combination with a suitable commercially available padlock without having to make any modifications to the padlock. One example of padlocks that work well with my invention are those manufactured under the trademark MASTER™. These padlocks are known to be very strong and tamper resistant and therefore well suited for securing a firearm.

Figure 1:
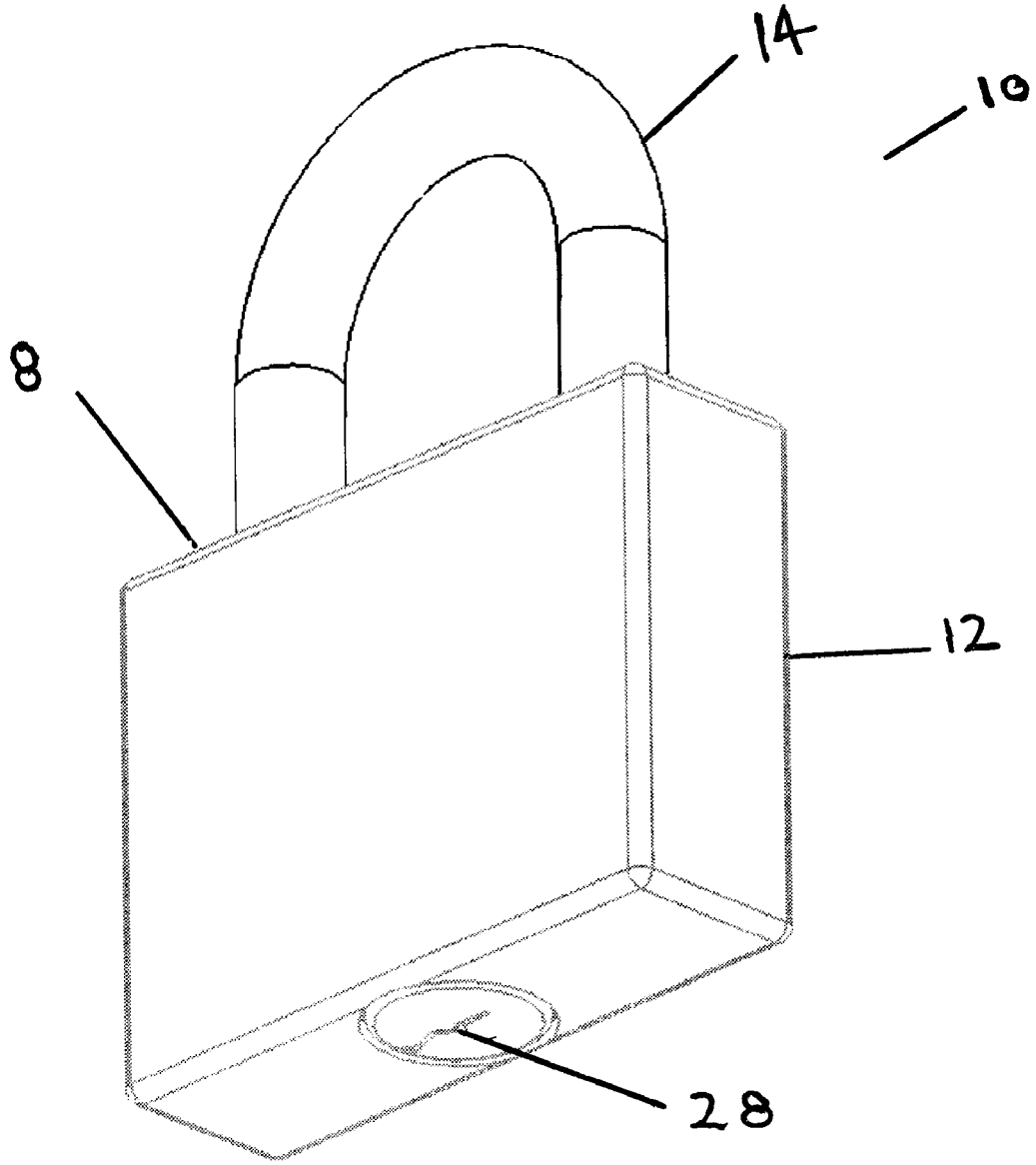
FIG. 1 illustrates in perspective view a padlock suitable for use as part of my invention in the closed position.
Figure 2:
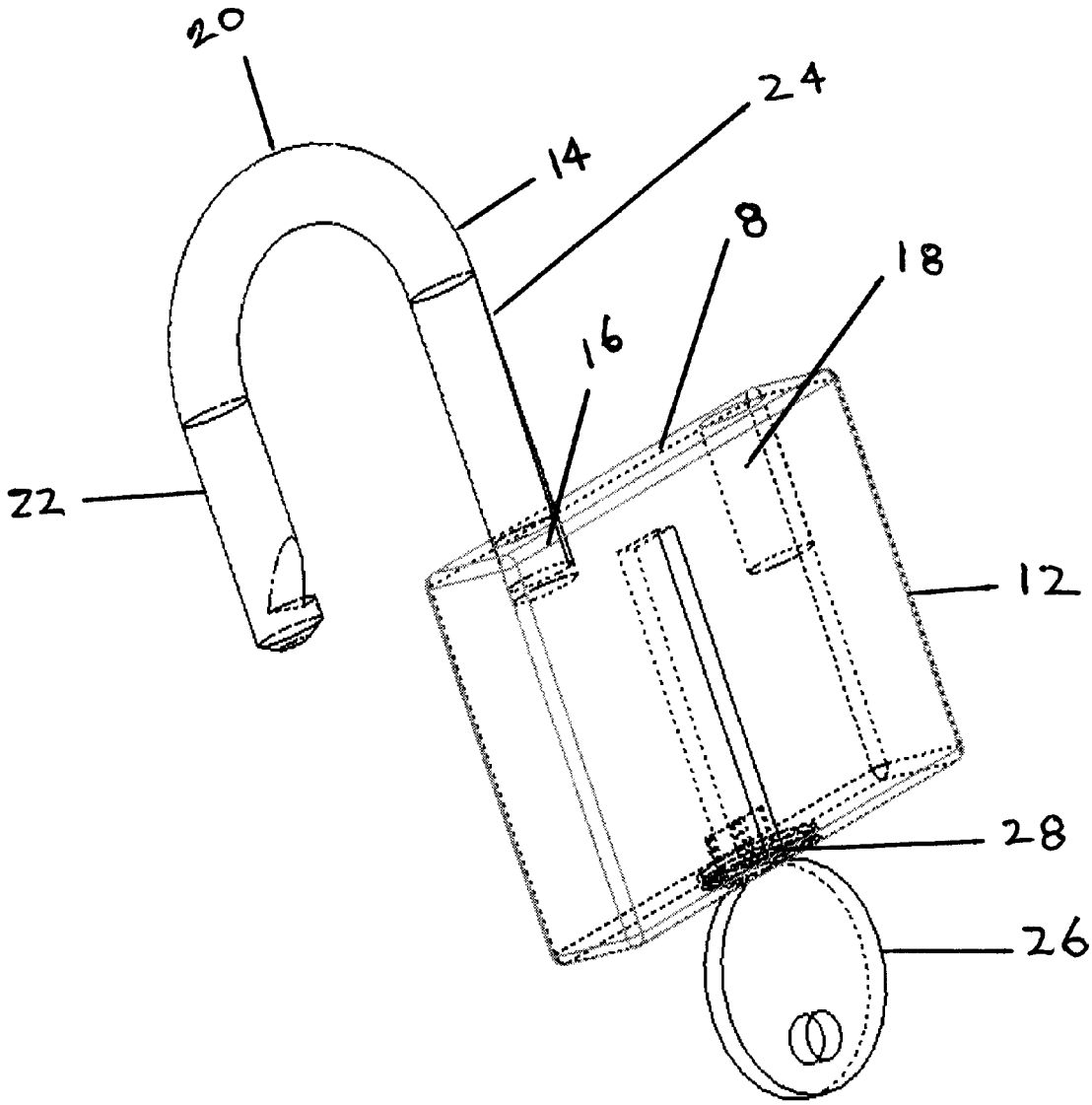
FIG. 2 illustrates the same padlock in another perspective view for use as part of my invention in the open position.

FIG. 1 and FIG. 2 illustrates padlock 10 suitable for use with my trigger lock in the closed position and open position respectively. Padlock 10 has a top surface 8 and is comprised of locking body 12, which engages both ends of shackle 14 within a locking socket 18 and, swivel socket 16. Shackle 14 is typically hardened steel rod formed into a "U" shaped shackle comprised of a semi-circular head 20 and a first leg 22 and a second leg 24 depending from the head. Means for locking and unlocking the shackle from the locking body is shown in FIG. 2 as key 26 inserted into key lock 28. A padlock with a combination locking means may also be used.

When the padlock is opened, first leg 24 is disengaged from the locking socket 18 of the locking body 12 it is free to pivot about locking socket 16 in which second leg 24 is permanently secured.

Figure 3:
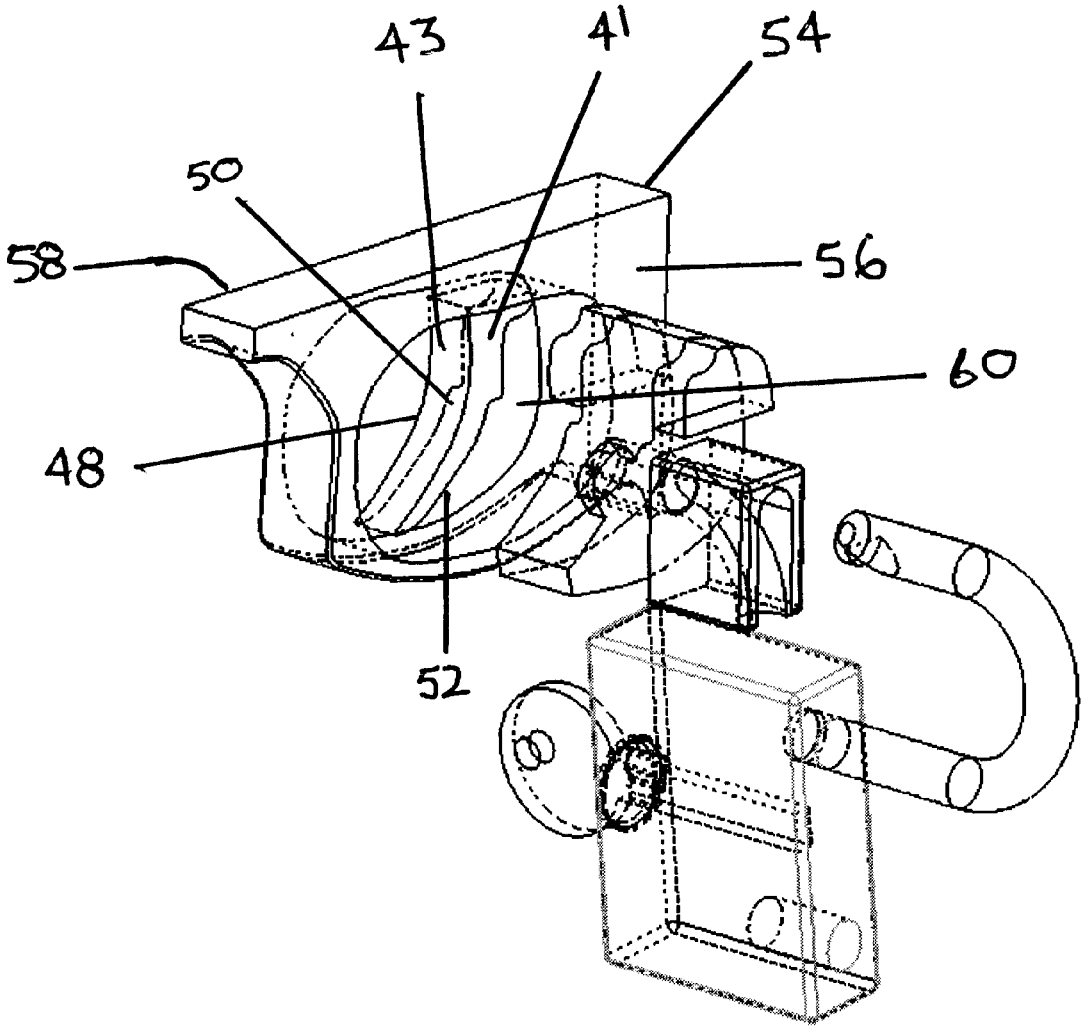

FIG. 3 illustrates a common trigger guard 54 as might be found on a variety of typical firearms. It is to be understood that my invention is easily adaptable to almost any manufacture of handgun having a trigger 48 and trigger guard 54 similar to that illustrated here. The trigger guard 54 surrounds trigger 48. The trigger 48 has a front surface 50, a rear surface 52, a first side 41 and a second side 43. The trigger guard has a first side 56 and a second side 58. Void 60 is created between the rear surface of the trigger 52 and the trigger guard 54. Typically the width of the trigger is slightly less than the width of the trigger guard.

Figure 4:
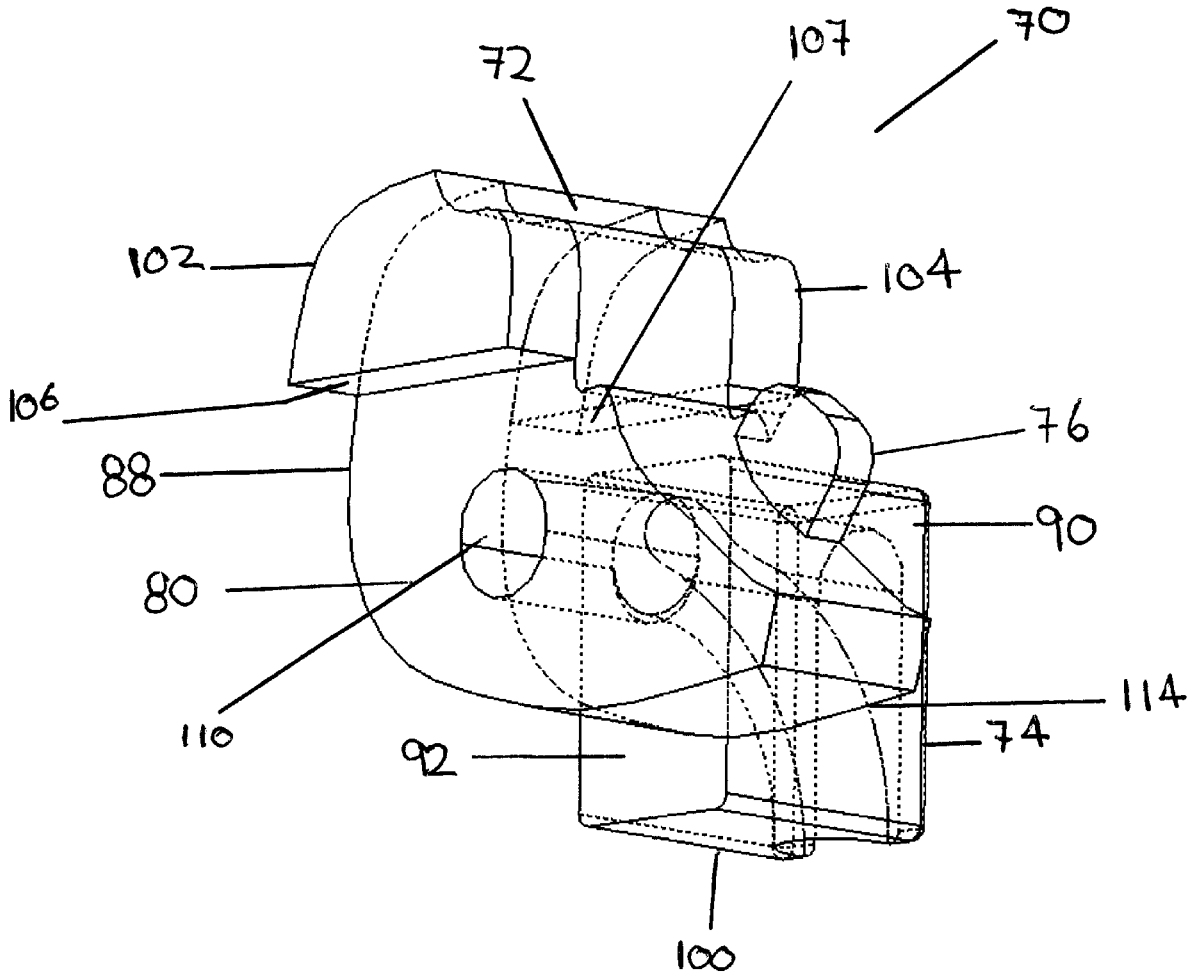
FIG. 4 illustrates in perspective view one embodiment of the locking body of my invention.
Figure 5:
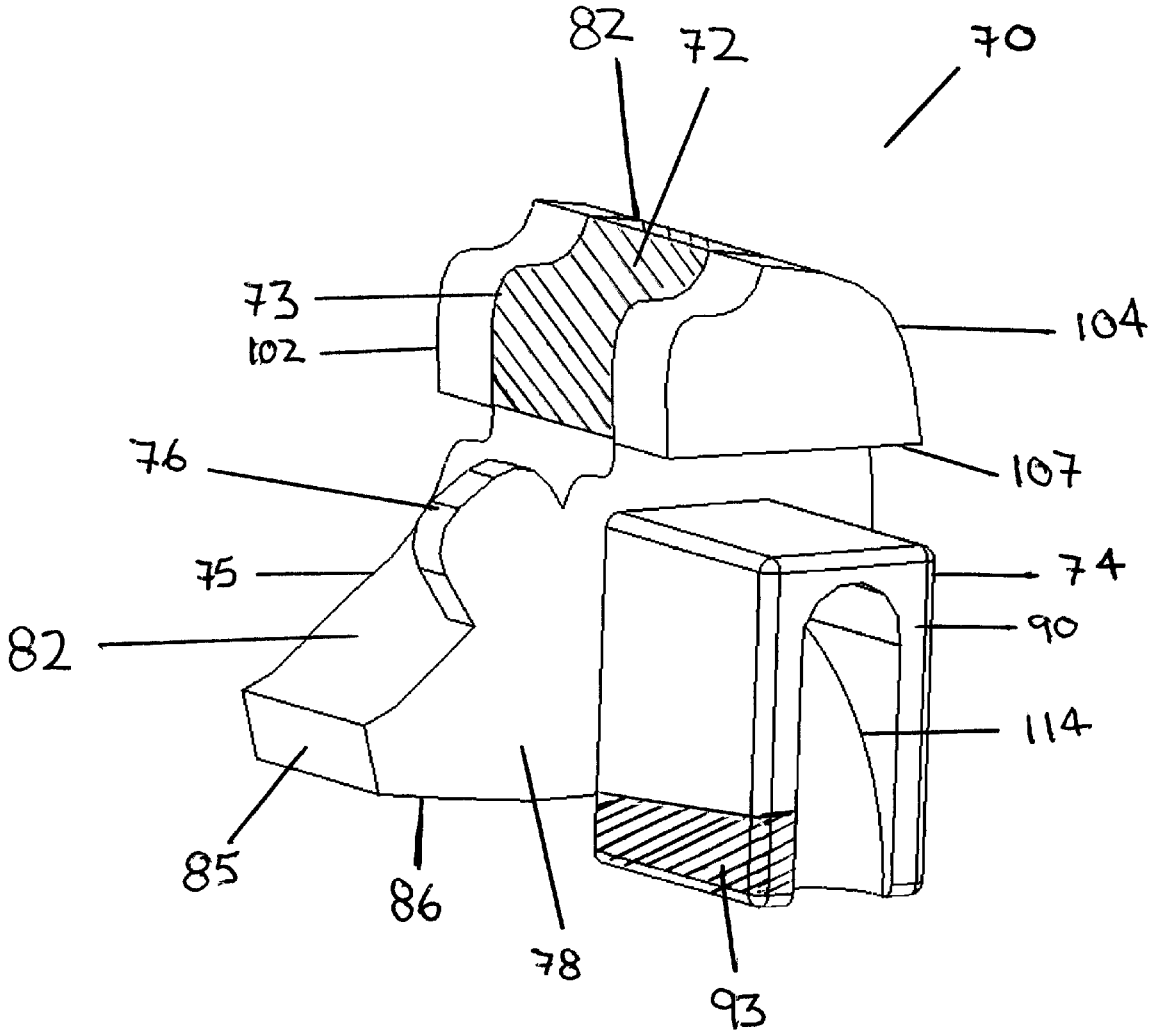
FIG. 5 illustrates the same embodiment of the locking body of my invention shown in FIG. 4 from a different perspective.

FIG. 4 and FIG. 5 illustrate one embodiment of the trigger lock body 70 of my invention from different perspectives. Locking body 70 comprises a trigger blocking portion 72 for placement behind the trigger 48 of a firearm to prevent rearward movement of the trigger 48 to a firing position. The trigger blocking portion 72 has a head 73 (shown as hash marked portion) and a body 75 and a width at least equal to the trigger but generally slightly wider than the width of the trigger. The trigger blocking portion 72 is configured to substantially fill the void 60 between the rear of the trigger 48 and the trigger guard 54 to prevent required movement of the trigger to a firing position. A flange 74 is placed adjacent to and integral with the trigger blocking portion 72 for positioning in an abutting relationship with side 56 of the trigger guard 54 thereby preventing lateral and twisting movement of the trigger blocking portion 72. Stop member 76 is integral to the trigger blocking portion 72 and raised from the side 78 of the trigger blocking portion and is adapted to engage in an abutting relationship the side 43 of the trigger 48. Stop 76 assists flange 74 to prevent lateral movement 73 of the locking body 70 within the trigger guard 54. Alternatively, stop member 76 may be removed thereby leaving flange 74 to absorb twisting forces placed on the trigger lock body.

Still referring to FIGS. 4 and 5 the trigger blocking portion 72 comprises, a first side 78, a second side 80, a front surface 82, a top surface 84, a bottom surface 86 and a rear surface 88. Front surface 82 is concave in shape and adapted to generally agree with the rearward convex-shaped surface of the trigger 48. Rear surface 88 is convex in shape and adapted to generally agree with the concave-shaped trigger guard 54. Top surface 84 is generally rounded and adapted to extend upwards towards the top of the trigger guard 54 so that it substantially fills void 60 and prevents rearward movement of the trigger 48 to a firing position. Bottom surface 86 is generally curved in a convex shape and tapered to a truncation 85 that extends downwards and forwards to the bottom of the trigger 48 to further fill void 60.

Still referring to FIGS. 4 and 5, flange portion 74 comprises a first side 90, a second side 92, a front surface 94, a rear surface 96, a top surface 98 and a bottom surface 100. At least 50% of first side 92 of flange 74 is attached to and integral with side 78 of the trigger blocking portion 72. The bottom portion 93 (shown in the hash lines) of flange 74 extends below the bottom of the trigger guard 54 to inhibit lateral and twist movement of the trigger blocking portion 72. Flange 74 is substantially rectangular in shape.

Shoulder portions 102 and 104 extend from the head portion (shown as 73 in the hashed area) of the trigger blocking portion 72. They are contiguous with and integral to each side of the head 73 of trigger blocking portion 72 respectively and have the same top surface profile as the trigger blocking portion. The bottom surface 106 and 107 of shoulder 102 and 104 respectively are flat and parallel to the flat bottom surface 100 of the flange portion 74.

Figure 6:
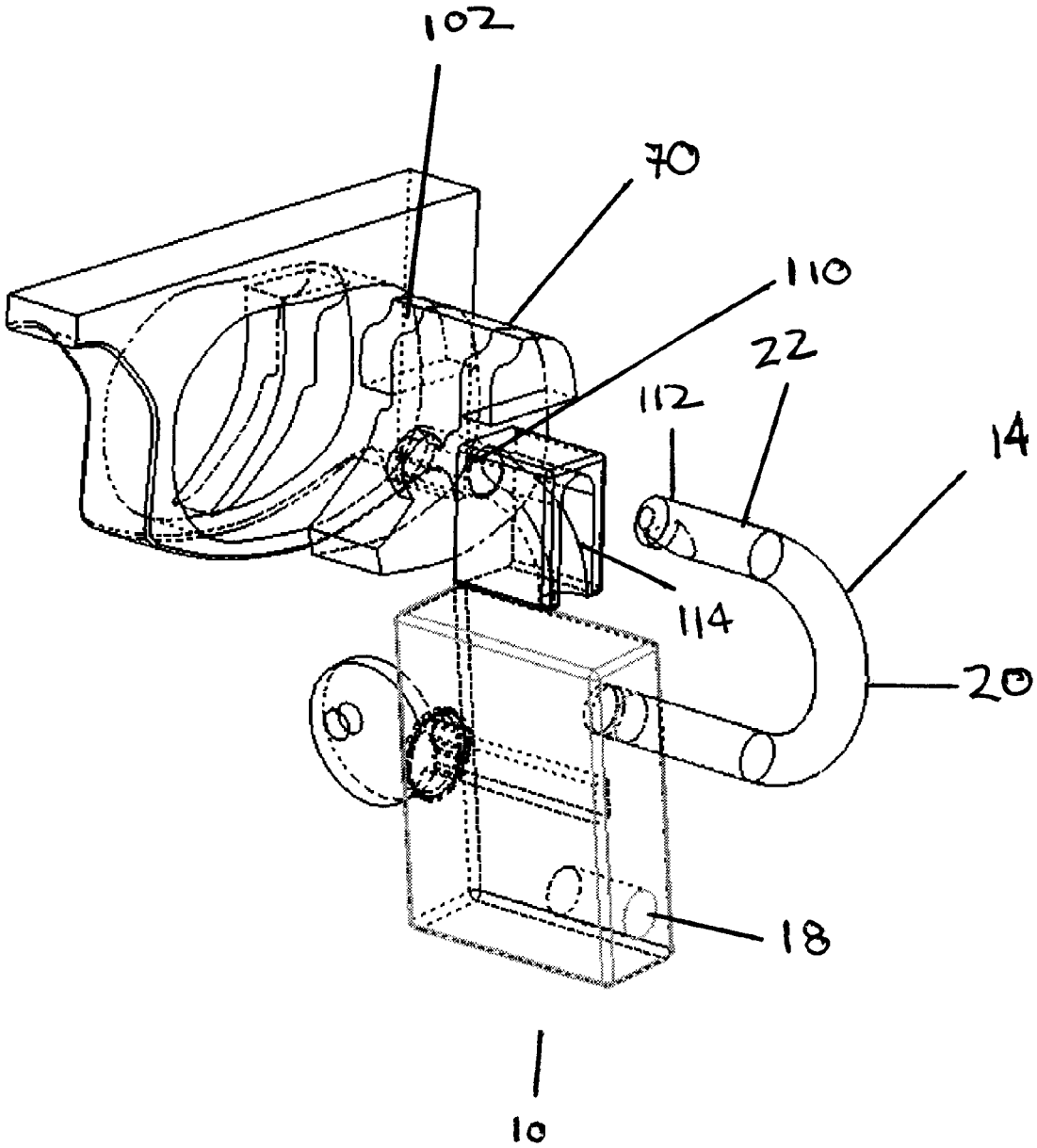
FIG. 6 illustrates one embodiment of my invention mounting in a sliding engagement with a shackle of a padlock suitable for use in my invention.

Referring now to FIGS. 4, 5 and 6 together there is illustrated the manner in which the locking body 70 of my invention is removably and slidably mounted to the shackle 14 of a padlock 10 to advantageously form a single piece trigger lock. This greatly reduces the chances of losing the locking body when it is removed from the firearm. FIGS. 4, 5 and 6 illustrate that the locking body 70 has means for removable and slidingly mounting itself to leg 22 of the U-shaped shackle 14 of a padlock 10. The means comprises an aperture 110 through the flange portion 74 and the trigger blocking portion 72 of the guard body 70. The aperture 110 is sized to receive 24 of shackle 14 in frictional sliding engagement by using hand force. Once guard body 70 is placed onto the shackle leg 22 the locking tip 112 of the leg 22 is exposed beneath the shoulder portion 102 of the body 70 for lockable engagement with socket 18 in the locking body 12 of the padlock 10. Also shown in FIGS. 4, 5 and 6 is groove 114 within the surface 90 of flange 74. Groove 114 is adapted in shape receive the head 20 of the U-shaped shackle 14. Groove 114 is sufficiently deep to enclose the head of the U-shaped shackle so that the top surface of the head 20 of the shackle 14 is substantially flush with the outside side surface of the flange 90.

Figure 7:
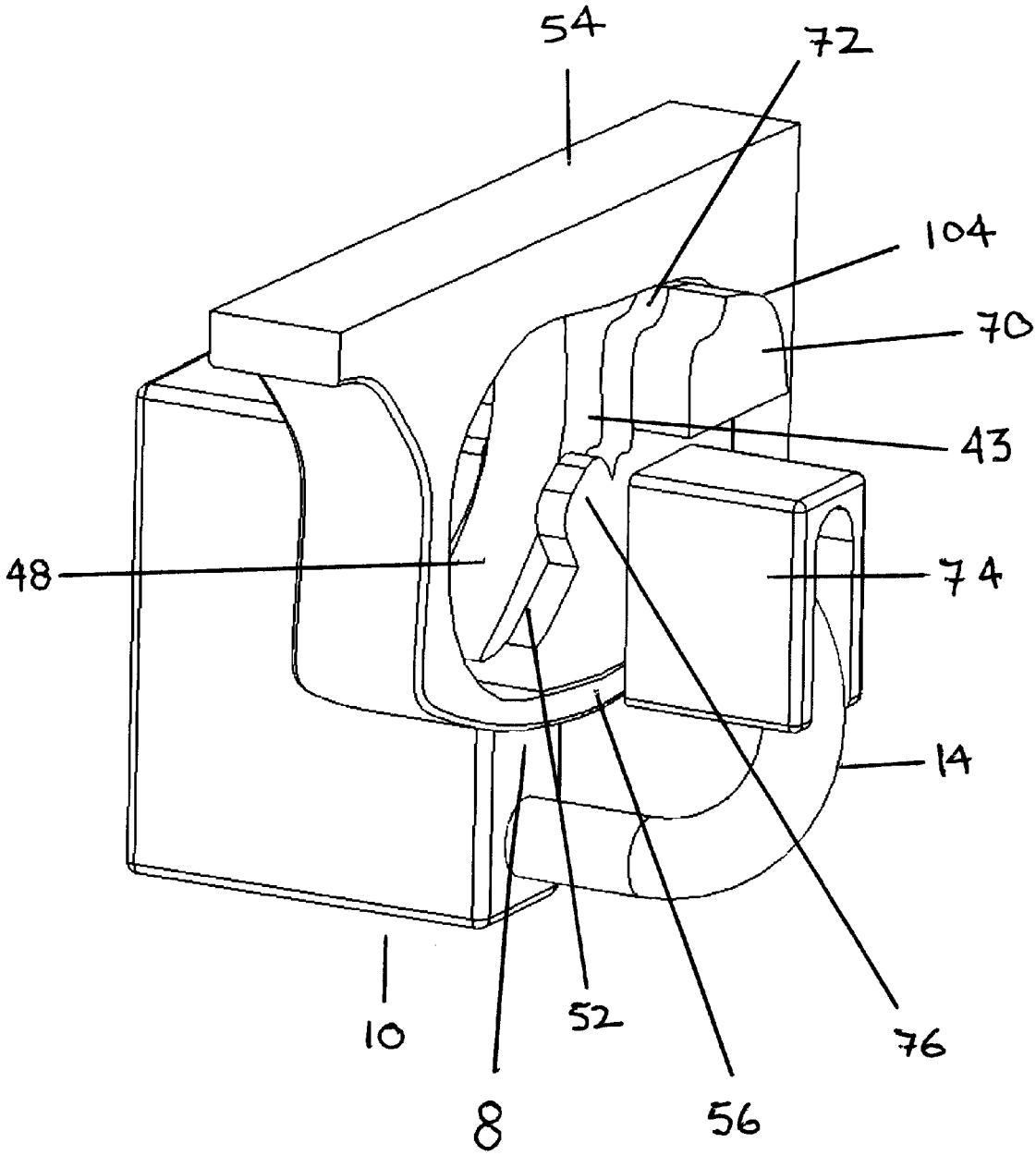
FIG. 7 illustrates one embodiment of my invention mounted on a shackle of a closed padlock and placed behind the trigger of a firearm.
Figure 8:
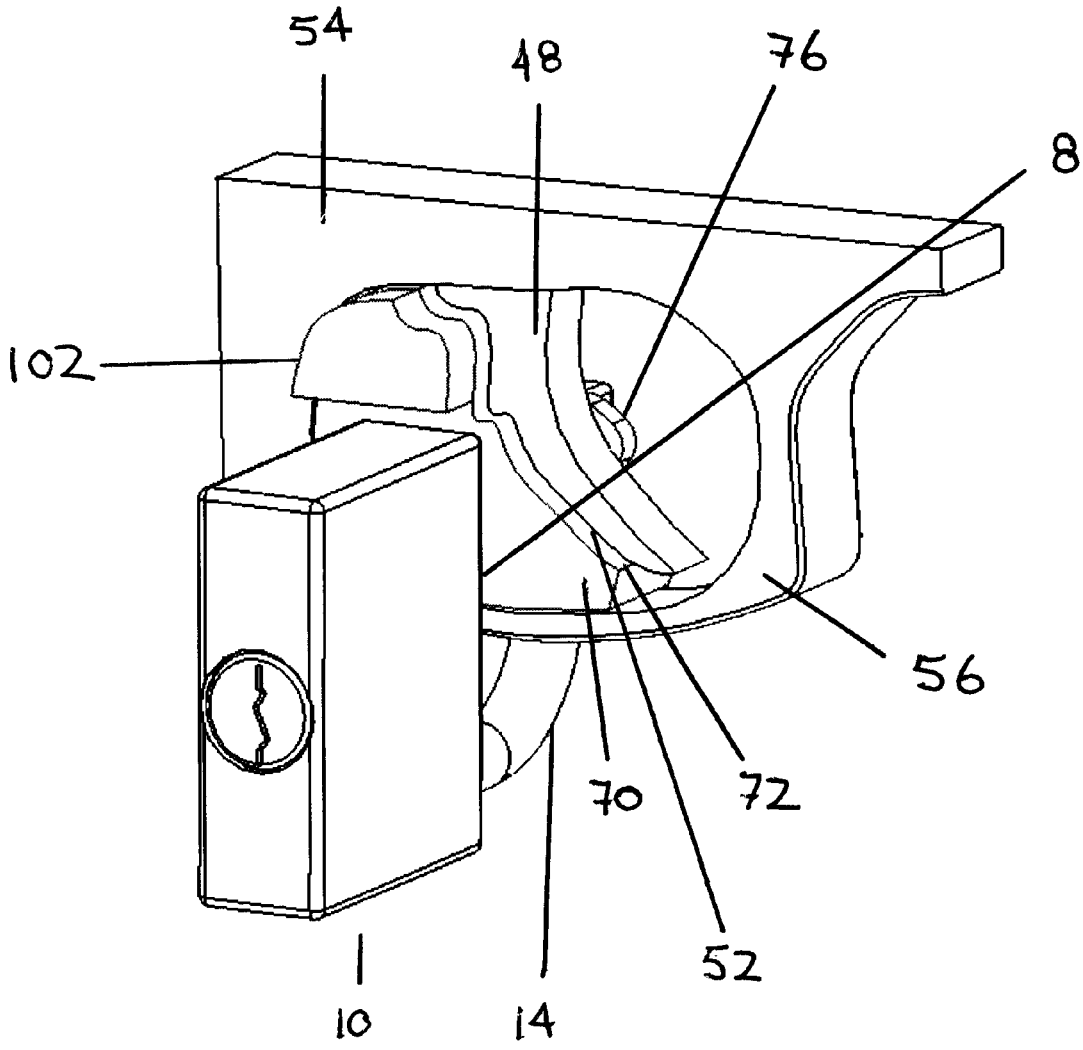
FIG. 8 illustrates the same embodiment as that in FIG. 7 from a different perspective.

Referring now to FIG. 7 and FIG. 8, there is shown one embodiment of my invention locking body 70 mounted to the shackle 14 of a padlock 10 and the shackle 14 and locking body 70 combination placed behind the trigger 48 within trigger guard 54. The blocking portion 72 is placed in sliding engagement behind the rear surface 52 of the trigger 48 so that rearward movement of the trigger to a firing position is prevented. Trigger stop 76 abuts against the side 43 of trigger 48 to prevent the locking body from sliding too far into the trigger guard. Flange 74 abuts against the side 56 of the trigger guard and also prevents any lateral movement of the locking body within the trigger guard. The stop 76 and the flange 74 also prevent any twisting movement of the locking body within the trigger guard 54. It is important to note that one advantage of my invention is to place the shackle of the lock in combination with the locking body horizontally behind the trigger instead of hanging the padlock vertically beside trigger guard. This configuration prevents twisting of the lock and breaking of the locking body. It is virtually impossible to remove the combined shackle and locking body without having to cut the trigger guard away from the frame of the firearm or cut the shackle of the lock. It also prevents scratching of the firearm.

Shoulder portions 102 and 104 of the locking body 70 extend from both sides of the blocking portion 72 and are integral to the blocking portion. The shoulders to provide additional resistance to any attempt to twist the locking body from the behind the trigger. There is at least one shoulder although there may be two.

Still referring to FIG. 7 and FIG. 8, there is shown my invention mounted behind the trigger 48 with the padlock 10 closed and locked. The top surface 8 of the locking body 12 of the padlock 10 abuts against the opposite side 58 of the trigger guard 54 and forms an opposing abutment to flange 74. In this manner the body 70 is sandwiched between the top surface of the padlock locking body 8 abutting against side 58 and flange 74 abutting against side 56.

The embodiment of my invention shown in FIGS. 4 and 5 will accommodate many types of trigger and trigger guard configurations. However, some trigger and trigger guard configurations will demand that an inventory of trigger lock bodies by kept with each one configured to exactly fit a different make of firearm. For that reason, additional embodiments of my invention are described below.

Figure 9:
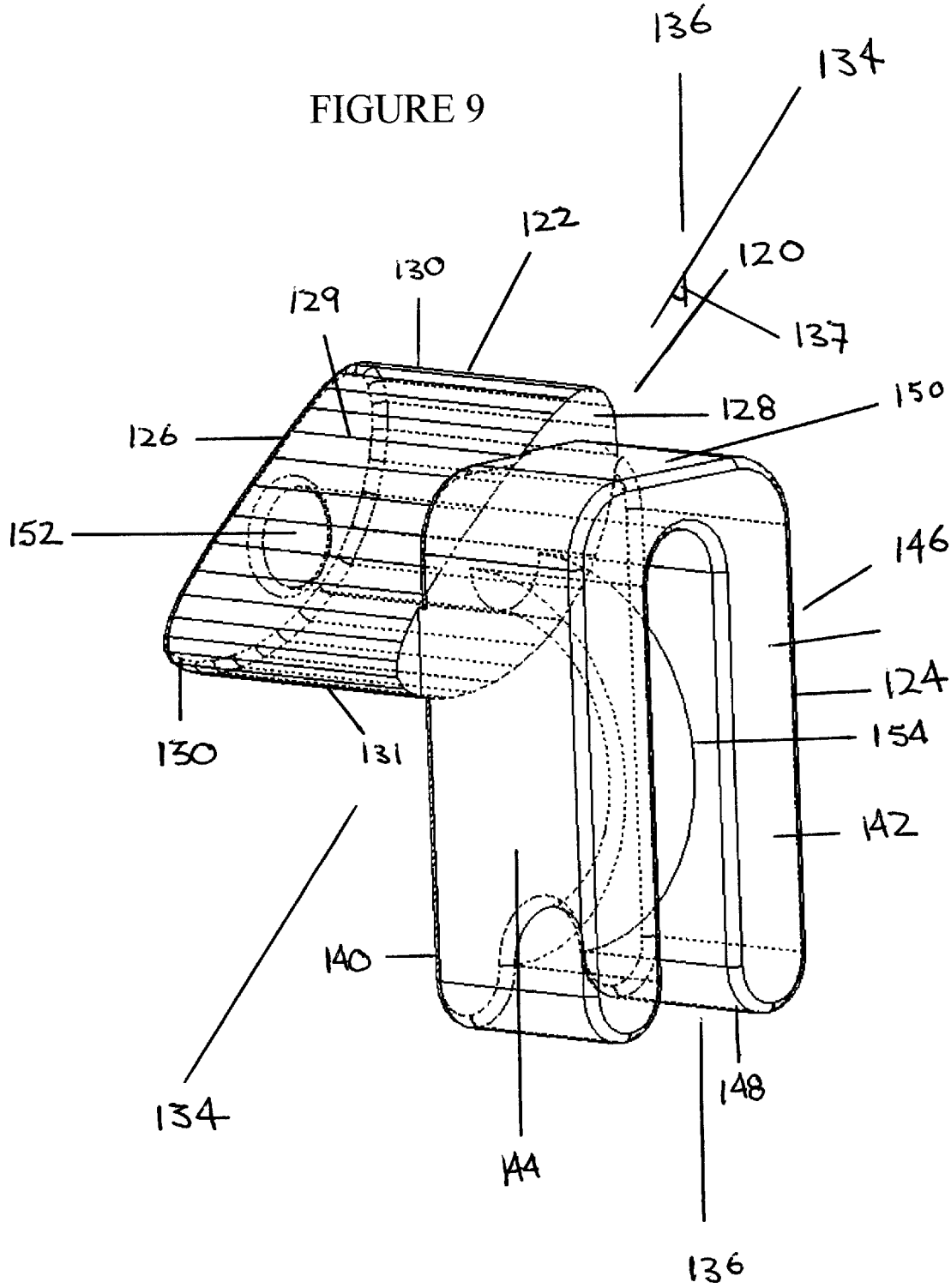
FIG. 9 illustrates another embodiment of the locking body of my invention.

Referring now to FIGS. 3 and 9 there is shown an alternate embodiment 120 of the locking body of my invention suited to firearms having a small void 60 behind trigger 48.

The locking body 120 of this embodiment of my invention comprises a trigger blocking portion 122 for placement behind the trigger 48 to prevent rearward movement of the trigger to a firing position. The trigger blocking portion is configured to substantially fill the void 60 between the rear of the trigger 52 and the trigger guard 54. A flange portion 124 is placed adjacent to and integral with the trigger blocking portion 122 for positioning in an abutting relationship with side 56 of the trigger guard 54 thereby preventing lateral and twisting movement of the trigger blocking portion 122.

Still referring to FIG. 9 the trigger blocking portion 122 comprises, a first side 126, a second side 128, a front surface 129, a top surface 130, a bottom surface 132 and a rear surface 131. Front surface 129 and rear surface 131 are both generally concave so that blocking portion 122 is generally ovular in shape with an axis 134 that is disposed at an angle 137 of less than 90 degrees to the horizontal axis 136 of flange 124. Blocking portion 122 is adapted to substantially fill the void behind trigger 48.

Referring to FIG. 9, flange portion 124 comprises a first side 140, a second side 142, a front surface 144, a rear surface 146, a top surface 150 and a bottom surface 148. Side 128 of the blocking portion 122 is fixed to and integral with side 140 of flange 124. The bottom surface 148 is adapted to extend below the bottom of the trigger guard 54 to inhibit lateral movement of the trigger blocking portion 122. Flange 124 is substantially rectangular in shape.

Referring to FIGS. 6 and 9, there is illustrated the manner in which the locking body 120 of my invention is mounted to the shackle 14 of a padlock 10 to advantageously form a single piece trigger lock. The means comprises an aperture 152 through the flange 124 and the trigger blocking portion 122 of the guard body 120. The aperture 150 is sized to receive leg 22 of shackle 14 in frictional sliding engagement by using hand force. Also shown in FIG. 9 is groove 154 within flange 124. Groove 154 is adapted in shape receive the head 20 of the U-shaped shackle 14. The groove is sufficiently deep to enclose the head of the U-shaped shackle so that the top surface of the head of the shackle is substantially flush with the outside side surface of the flange 124. Body 120 is mounted to a padlock shackle and placed behind the trigger of a firearm substantially as shown in FIG. 6.

Figure 10:
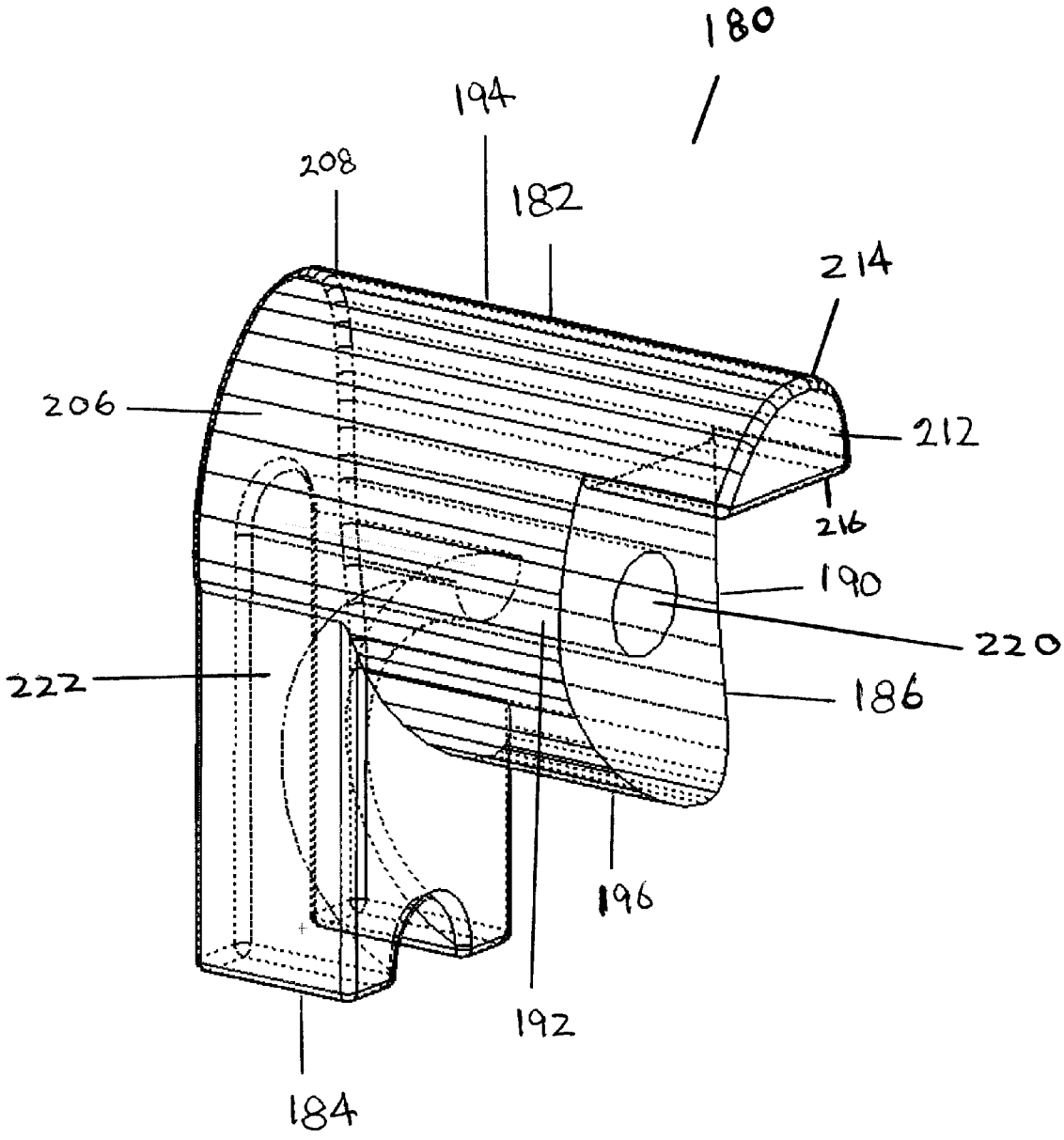
FIG. 10 illustrates yet another embodiment of the locking body of my invention.
Figure 11:
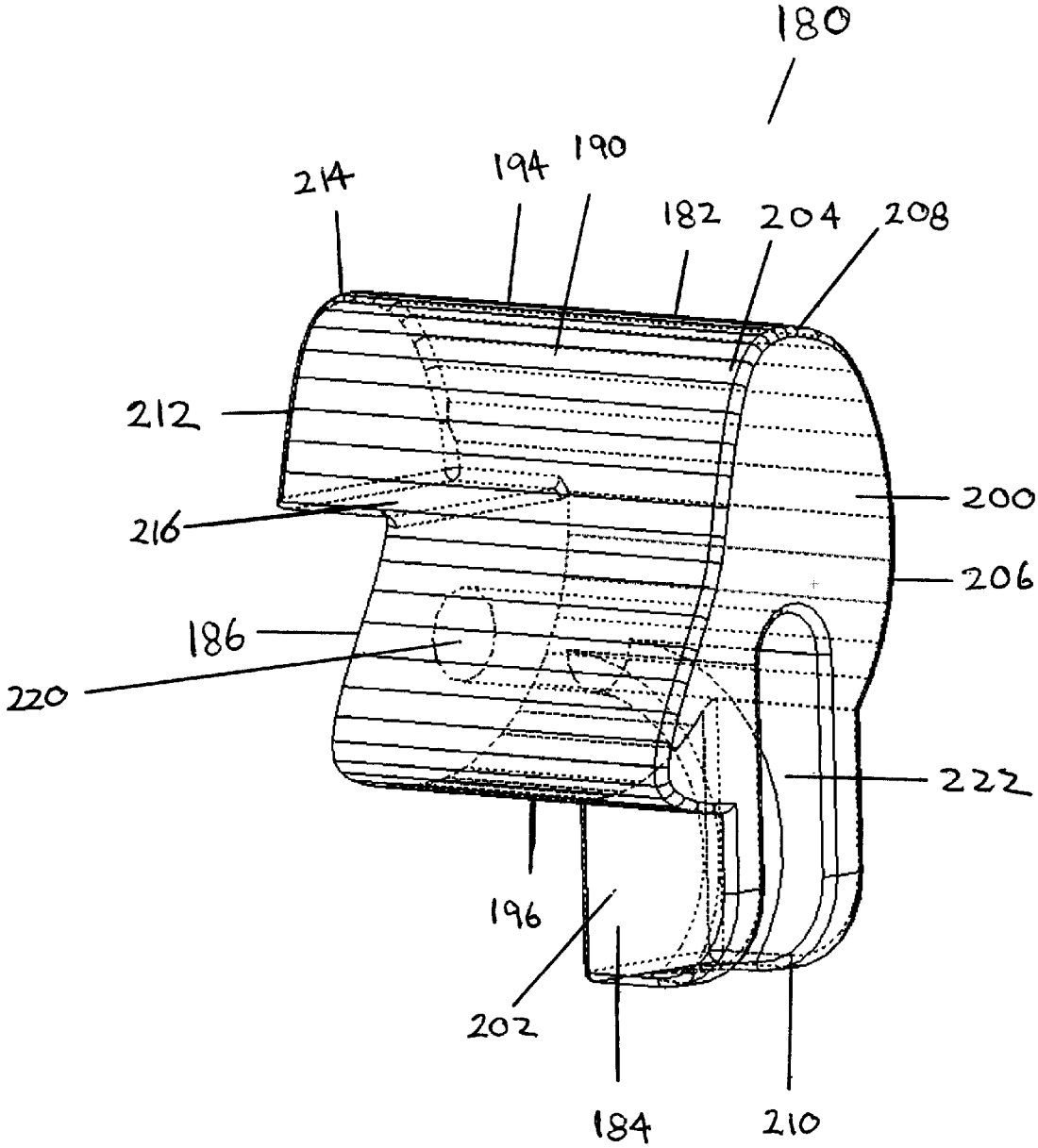
FIG. 11 illustrates the same embodiment of FIG. 10 from a different perspective.

Referring now to FIGS. 10 and 11 there is shown yet another embodiment of my invention. The locking body 180 comprises a trigger blocking portion 182 for placement behind the trigger of a firearm to prevent rearward movement of the trigger to a firing position. The trigger blocking portion may have a width equal to the trigger or slightly wider than the width of the trigger. The trigger blocking portion is configured to substantially fill the void 60 between the rear of the trigger 52 and the trigger guard 54. A flange 184 is placed adjacent to and integral with the trigger blocking portion 182 for positioning in an abutting relationship with side 56 of trigger guard 54 thereby preventing lateral and twisting movement of the trigger blocking portion.

Still referring to FIGS. 10 and 11 the trigger blocking portion 182 comprises, a side 186, a front surface 190, a top surface 194, a bottom surface 196 and a rear surface 192. Front surface 190 is concave in shape and adapted to generally agree with the rearward convex-shaped surface of the trigger 48. Rear surface 192 is convex in shape and adapted to generally agree with the concave-shaped trigger guard 54. Top surface 194 is rounded and tapered and adapted to extend upwards towards the top of the trigger guard 54 so that the body 180 substantially fills void 60. Bottom surface 196 is rounded and tapered and adapted to extend downwards towards the bottom of the trigger 48 again to fill void 60.

Still referring to FIGS. 10 and 11, flange portion 184 comprises a first side 200, a second side 202, a front surface 204, a rear surface 206, a top surface 208 and a bottom surface 210. Side 202 is partially contiguous and integral with the trigger blocking portion 182. Flange 184 extends substantially below the bottom of the trigger guard 54 to inhibit lateral movement of the trigger blocking portion. Top surface 208 of flange 184 has a profile identical to that of the top surface 182 of the trigger blocking portion and a back surface 206 that is substantially planar. Bottom surface 210 of the flange is flat.

Shoulder portion 212 is contiguous with and integral to the first side 186 of the trigger blocking portion 182 and has generally semi-circular shape having a top surface 214 profile identical to the top surface profile 194 of the trigger blocking portion 182 and a bottom surface 216 that is flat and parallel with the flat bottom surface 210 of the flange portion.

Still referring to FIGS. 10 and 11 there is shown aperture 220 through the flange portion 184 and the trigger blocking portion 182 of the guard body 180 for mounting the body to the shackle of a padlock. Aperture 220 is sized to receive leg 22 of shackle 14 in frictional sliding engagement by using hand force. Once body 180 is placed onto the shackle leg 22 the locking tip 82 of the leg 22 is exposed beneath the shoulder portion 212 of the body 180 for lockable engagement with the locking body 12 of the padlock 10. Also shown is groove 222 within the surface 200 of the flange portion 184 of the guard body 180. The groove 222 is adapted in shape receive the head 20 of the U-shaped shackle 14. The groove is sufficiently deep to enclose the head of the U-shaped shackle so that the top surface of the head of the shackle is flush with the outside side surface of the flange.

The body 180 mounts to a padlock shackle and behind the trigger 48 of a firearm as shown in FIG. 6.

Although this description contains much specificity, these should not be construed as limiting the scope of the invention by merely providing illustrations of some of the embodiment of the invention. Thus the scope of the invention should be determined by the appended claims and their legal equivalents rather than by the examples given.

What is claimed is:

1. A trigger lock for a firearm said firearm having a trigger, said trigger having a front surface and a rear surface, a first side and a second side, the trigger enclosed within a trigger guard, said trigger guard having a first side and a second side and creating a void between the rear surface of the trigger and the trigger guard, said trigger lock comprising:

a. a trigger lock body comprising:

i. a trigger blocking portion having a first side, a second side, a head and a body for placement behind the trigger to prevent rearward movement of the trigger to a firing position;

ii. a flange adjacent to and integral with said trigger blocking portion for positioning in an abutting relationship with said first side of said trigger guard thereby preventing lateral and twisting movement of the trigger blocking portion once placed behind the trigger;

iii. at least one shoulder portion extending laterally from said head of said body and contiguous with and integral thereto said shoulder extending beyond the corresponding side of the trigger guard when the body is placed behind the trigger, to resisting twisting motion thereof;

b. a padlock having a first opened position and a second closed position and comprising a locking body having a top surface, a first locking socket in said top surface, a second locking socket in the top surface opposite the first locking socket, and a U-shaped shackle said shackle having a head from which depends a first leg lockably disengagable from the first locking socket and a second leg pivotally and permanently engaged to the second locking socket wherein the trigger lock body is mounted onto said first leg of the shackle; and, c. means for removably and slidingly mounting the trigger lock body in a frictional engagement using hand force on to the first leg of the shackle permitting the combined trigger lock body and first leg to be positioned horizontally behind the trigger such that when the trigger blocking portion is behind the trigger and the padlock is closed, the top surface of the padlock creates an abutment abutting against said second side of the trigger guard thereby preventing lateral movement of the trigger lock body within the trigger guard.

2. The trigger lock as claimed in claim 1 wherein the trigger lock body comprises:

a. a trigger blocking portion for placement behind the trigger to prevent rearward movement of the trigger to a firing position;

b. a flange adjacent to and integral with the trigger blocking portion for positioning in an abutting relationship with said first side of said trigger guard thereby preventing lateral and twisting movement of the trigger blocking portion;

c. a stop member integral to the trigger blocking portion and raised from said second side of the trigger blocking portion and adapted to engage in an abutting relationship with said second side of the trigger to prevent lateral and twisting motion of the body once placed behind the trigger; and, d. at least one shoulder portion extending laterally from the head of the body and contiguous with and integral thereto, said shoulder extending beyond the corresponding side of the trigger, guard when the body is mounted in the trigger guard to resisting twisting motion thereof.

3. The trigger lock as claimed in claim 1 wherein the trigger lock body comprises two identical shoulders extending from each side of the head of the trigger lock body.

4. The trigger lock as claimed in claim 1 wherein the trigger blocking portion has a width greater than the width of the trigger.

5. The trigger lock as claimed in claim 1 wherein the trigger blocking portion has a width equal to the width of the trigger guard.

6. The trigger lock as claimed in claim 1 wherein the trigger blocking portion comprises, a first side, a second side, a front surface, a rear surface, a top surface, and a bottom surface, wherein:

a. the front surface is concave in shape and adapted to generally agree with the convex-shaped rear surface of the trigger;

b. the rear surface is convex in shape and adapted to generally agree with the concave-shaped trigger guard;

c. the top surface is rounded and adapted to fill the void by extending upwards towards the bottom of the trigger guard; and, d. the bottom surface is rounded and tapers to a truncation and is further adapted to fill the void by extending downwards towards the bottom of the trigger.

7. The trigger lock as claimed in claim 6 wherein the flange comprises a rectangular body having a first side, a second side, a front surface, a rear surface, a top surface and a bottom surface and wherein at least 50% of said first side of the flange portion is fixed to and integral with the second side of the trigger blocking portion.

8. The trigger lock as claimed in claim 7 wherein said bottom side of the flange extends below the bottom of the trigger guard to inhibit lateral and twisting movement of the body in the trigger guard.

9. The trigger lock as claimed in claim 1 wherein said at least one shoulder portion is contiguous with and integral to the head of the trigger blocking portion.

10. The trigger lock as claimed in claim 1 wherein said means for removably and slidingly mounting the guard body to the U-shaped shackle of a padlock comprises:

a. an aperture through the flange and the trigger blocking portion of the trigger lock body said aperture sized to receive the first leg of said shackle in frictional sliding engagement such that when the trigger lock body is placed onto the shackle the locking tip of the shackle is exposed beneath the shoulder portion of the trigger lock body for lockable engagement with the locking body of the padlock; and, b. a groove in communication with said aperture, said aperture positioned within the second surface of the flange of the trigger lock body, the groove adapted in shape receive the head of the U-shaped shackle and the groove being sufficiently deep to enclose the head of the U-shaped shackle so that the top surface of the head of the shackle is flush with the second side surface of the flange.

11. The trigger lock as claimed in claim 10 wherein the trigger lock body is mounted to the shackle and positioned behind the trigger and wherein once the padlock is locked closed the trigger blocking portion is sandwiched between the flange and the top surface of the locking body abutting against the first side of the trigger guard thereby preventing and lateral and twisting movement of the trigger lock body in its locked position and also preventing the unwanted removal of the body from the trigger guard.

12. The trigger lock as claimed in claim 1 wherein the trigger lock body comprises:

i. a trigger blocking portion having a first side, a second side, a front surface and a rear surface, a top surface and a bottom surface wherein said front and rear surfaces are generally concave thereby forming a trigger blocking portion that is ovular;

ii. a flange adjacent to and integral with the trigger blocking portion for positioning in an abutting relationship with said first side of said trigger guard thereby preventing lateral and twisting movement of the trigger blocking portion once placed behind the trigger.

13. The trigger lock as claimed in claim 1 wherein the trigger lock body comprises:

a. a trigger blocking portion for placement behind the trigger to prevent rearward movement of the trigger to a firing position;

b. a flange adjacent to and integral with the trigger blocking portion for positioning in an abutting relationship with said first side of said trigger guard thereby preventing lateral and twisting movement of the trigger blocking portion in a first lateral direction;

c. means for removably mounting the guard body in a cooperative sliding engagement on to the first leg of the shackle permitting the combined guard body and first leg to be positioned behind the trigger such that when the trigger blocking portion is behind the trigger and the padlock is closed, the top surface of the padlock creates a second flange portion abutting against said second side of the trigger guard preventing movement of the trigger blocking portion in a second lateral direction being opposite to said first lateral direction.

14. A trigger lock for a firearm said firearm having a trigger, said trigger having a front surface and a rear surface, a first side and a second side, the trigger enclosed within a trigger guard, said trigger guard having a first side and a second side and creating a void between the rear surface of the trigger and the trigger guard, said trigger lock comprising:

a. a trigger lock body comprising:

i. a trigger blocking portion for placement behind said trigger to prevent rearward movement of the trigger to a firing position;

ii. a flange adjacent to and integral with said trigger blocking portion for positioning in an abutting relationship with said first side of said trigger guard thereby preventing lateral and twisting movement of the trigger blocking portion in a first lateral direction;

b. a padlock having a locking body with a top surface and a U-shaped shackle said shackle having a head from which depends first leg lockably disengagable from the top surface of the locking body and a second leg pivotally and permanently attached to the top surface of the locking body;

c. means for removably mounting the guard body in a cooperative sliding engagement on to the first leg of the shackle using hand force thus permitting the combined guard body and first leg to be positioned behind the trigger such that when the trigger blocking portion is behind the trigger and the padlock is closed, the top surface of the padlock creates a second flange portion abutting against said second side of the trigger guard preventing movement of the trigger blocking portion in a second lateral direction being opposite to said first lateral direction.

15.A trigger lock for a firearm said firearm having a trigger, said trigger having a front surface and a rear surface, a first side and a second side, the trigger enclosed within a trigger guard, said trigger guard having a first side and a second side and creating a void between the rear surface of the trigger and the trigger guard, said trigger lock comprising:

a. a trigger lock body comprising:

i. a trigger blocking portion having a first side, a second side, a front surface and a rear surface, a top surface and a bottom surface wherein said front and rear surfaces are generally concave thereby forming a trigger blocking portion that is ovular;

ii. a flange adjacent to and integral with the trigger blocking portion for positioning in an abutting relationship with said first side of said trigger guard thereby preventing lateral and twisting movement of the trigger blocking portion once placed behind the trigger;

b. a padlock having a first opened position and a second closed position and comprising a locking body having a top surface, a first locking socket in said top surface, a second locking socket in the top surface opposite said first locking socket, and a U-shaped shackle said shackle having a head from which depends a first leg lockably disengagable from the first locking socket and a second leg pivotally and permanently engaged to the second locking socket wherein said second leg is longer than said first leg, wherein the trigger lock body is mounted onto the first leg of the shackle; and, c. means for removably and slidingly mounting the trigger lock body in a frictional engagement using hand force on to the first leg of the shackle permitting the combined trigger lock body and first leg to be positioned horizontally behind the trigger such that when the trigger blocking portion is behind the trigger and the padlock is closed, the top surface of the padlock creates an abutment abutting against said second side of the trigger guard thereby preventing lateral movement of the trigger lock body within the trigger guard.

* * * * *